United States Patent [19]

Tomisawa et al.

[11] 3,979,989

[45] Sept. 14, 1976

[54] ELECTRONIC MUSICAL INSTRUMENT

[75] Inventors: Norio Tomisawa, Hamamatsu; Yasuji Uchiyama, Hamakita; Takatoshi Okumura; Toshio Takeda, both of Hamamatsu, all of Japan

[73] Assignee: Nippon Gakki Seizo Kabushiki Kaisha, Japan

[22] Filed: May 27, 1975

[21] Appl. No.: 581,184

[30] Foreign Application Priority Data

May 31, 1974 Japan ..... 49-61710
May 31, 1974 Japan ..... 49-61711

[52] U.S. Cl. ..... 84/1.01; 84/1.25
[51] Int. Cl.[2] ..... G04H 1/04
[58] Field of Search ..... 84/1.01, 1.03, 1.17, 84/1.25

[56] References Cited

UNITED STATES PATENTS

| | | | |
|---|---|---|---|
| 3,413,403 | 11/1968 | Jacob | 84/1.25 |
| 3,610,801 | 10/1971 | Fredkin | 84/1.03 |
| 3,697,661 | 10/1972 | Deutsch | 84/1.01 |
| 3,800,060 | 3/1974 | Hallman, Jr. | 84/1.24 |
| 3,801,721 | 4/1974 | Banger | 84/1.24 |
| 3,809,786 | 5/1974 | Deutsch | 84/1.03 |
| 3,871,261 | 3/1975 | Wells et al. | 84/1.01 |
| 3,882,751 | 5/1974 | Tomisawa | 84/1.01 |

*Primary Examiner*—E. S. Jackmon
*Attorney, Agent, or Firm*—Ladas, Parry, Von Gehr, Goldsmith & Deschamps

[57] ABSTRACT

In a digital type electronic musical instrument in which frequency information corresponding to a depressed key is cumulatively counted and a musical tone waveshape is read from a memory by the resultant output of the cumulative counting, modified frequency information is produced by adding to or subtracting from said frequency information second frequency information represented by a predetermined frequency difference. A tone of a pitch which is slightly different from a normal pitch is generated from this modified frequency information for producing a beat effect between notes in an octave relation. The pitch can be controlled by suitably adjusting the second frequency information. Different beat effects can be produced for respective keyboards by varying the second frequency information by each keyboard. According to an alternative embodiment of the invention, two or more sets of tone reproduction systems are provided and the beat effect is produced by depression of a single key by varying modified frequency information for the respective tone reproduction systems.

5 Claims, 10 Drawing Figures

4
15
SR1
Φ1
I3
OR4
I4
Sy1
Sy6
Sy25
$\overline{Sy25}$
Fm1
Fm2
Fm13
Fm14
OUTPUT SHIFT REGISTER
14
OR5
A35
A21
OR18
A48
A34
13
ADDER
10
S1
S2
S3
S4
S13
S14
A
B
12b
12a
F1
F2
F3
F13
F14
FREQUENCY INFORMATION MEMORY
7
P1
P2
P3
P4
SAMPLE AND HOLD CIRCUIT
11b
N1
N2
N3
N4
B1
B2
SAMPLE AND HOLD CIRCUIT
11a

ELECTRONIC MUSICAL INSTRUMENT

SUMMARY OF THE INVENTION

This invention relates to an electronic musical instrument and, more particularly, to an electronic musical instrument capable of producing a musical tone having a certain amount of difference in frequency against the nominal pitch of a note of a depressed key.

A digital type electronic musical instrument which produces a musical tone by digitally processing a signal generated upon depression of a key has many advantages over an analog type electronic musical instrument particularly in compactness in size and superior tone quality. It is not long, however, since the digital type electronic musical instrument came into being and there has not been an instrument of this type capable of providing a reproduced musical tone with a special musical tone effect obtainable by pitch controlling.

The term "pitch controlling" used herein means adjustment of a tone pitch. The "special musical tone effect", if used with respect to a single musical tone waveshape production system, signifies a beat effect produced between a plurality of tones in an octave relation (hereinafter referred to as "octave beat effect") by changing the respective frequencies of said plurality of tones in an octave relation uniformly, i.e. by the same amount, and thereby creating a certain lag in the interval of the plurality of tones the frequencies of which should normally be in an exact Harmonic overtone relation. This gives variety and vividness to the musical tones reproduced. In a plurality of musical tone waveshape production systems "the special musical effect" signifies a beat effect produced by changing the frequencies of the tones to be reproduced uniformly for each system and thereby creating a slight discrepancy between the frequencies of the plurality of tones which are of the same note. A slight sway produced in the reproduced tones due to the discrepancy between the frequencies can be produced by depression of a single key and will hereinafter be referred to as "the single key beat effect". Musical tones provided with this single key beat effect has a deep, solemn characteristic resembling that of a pipe organ.

If a beat effect is desired in a prior art analog type electronic musical instrument in which musical tone signals are synthesized from tone source signals obtained from a plurality of oscillators or frequency dividers, a plurality of oscillators are provided for oscillating frequencies which are slightly different from each other with respect to one and the same note and the outputs of such oscillators are respectively frequency divided. The difference in frequency obtained by the prior art frequency dividing method is not constant through all tone ranges but the ratio of the frequency difference is constant. Accordingly, the prior art method is disadvantageous in that the beat effect is excessively given in a higher tone range whereas it is insufficient in a lower tone range. There is another type of prior art device in which a couple of oscillators which produce frequencies which are slightly different from each other with respect to one and the same note are provided and these oscillators are simultaneously operated to produce the beat effect between the frequencies oscillated from these oscillators. The set values of the two oscillators provided for each key, however, tend to be affected by variations in ambient temperature with a result that the frequency difference for each tone varies irregularly and a stable beat effect can hardly be obtained.

It is, therefore, an object of this invention to provide a digital type electronic muscial instrument capable of producing a special musical effect by pitch controlling.

It is another object of the invention to provide a digital type electronic musical instrument capable of performing pitch controlling by each keyboard.

It is another object of the invention to provide an electronic musical instrument capable of producing a stable octave beat effect free from an adverse influence by ambient temperature with a very simple construction.

It is another object of the invention to provide an electronic musical instrument capable of producing a stable signle key beat effect free from an adverse influence by ambient temperature with a very simple construction.

It is still another object of the invention to provide an electronic musical instrument which can be composed of LSI and, therefore, made extremely compact.

These and other objects and features of the invention will become apparent from the description made hereinbelow with reference to the accompanying drawings.

DESCRIPTION OF THE PREFERRED EMBODIMENTS

I. Operation principle

To facilitate understanding, the operation principle of the device according to the invention will be briefly described.

If a certain amount of frequency difference $\Delta f$(Hz) is uniformly given to the frequency of each note (hereinafter referred to as "nominal frequency") in a scale whose octave relation is an exact harmonic overtone relation (hereinafter referred to as "nominal scale"), a new scale which is composed by modified frequencies which respectively have the frequency difference $\Delta f$ relative to the nominal frequencies (hereinafter referred to as "modified scale") is produced. If frequency of a fundamental tone in the nominal scale is represented by $f$(Hz), frequencies of harmonic overtones having an octave relation to the fundamental tone respectively are $2f$, $4f$, $8f$ . . . $16f$. In the modified scale, frequencies of these overtones respectively are $f-\Delta f$, $2f-\Delta f$, $4f-\Delta f$, $8f-\Delta f$, $16f-\Delta f$ . . .

It will be noted from the foregoing that the tones in an octave relation in the modified scale are not in an exact harmonic overtone relation. If the octaves are designated as the first octave, the second octave . . . starting from the lowest frequency, frequency difference between a high frequency tone $2f-\Delta f$ and a value obtained by doubling the frequency of a low frequency tone $f-\Delta f$ in the first octave is $(2f-\Delta f)-2(f-\Delta f)=\Delta f$, frequency difference between a high frequency tone $4f-\Delta f$ and a value obtained by doubling the frequency of a low frequency tone $2f-\Delta f$ in the second octave is $(4f-\Delta f)-2(2f-\Delta f)=\Delta f$ and frequency difference between a high frequency tone $8f-\Delta f$ and a value obtained by doubling the frequency of a low frequency tone $4f-\Delta f$ in the third octave is $(8f-\Delta f)-2(4f-\Delta f)=\Delta f$ respectively. It will be understood from the above description that the two tones in the octave are not in an exact harmonic overtone relation and that frequency difference between the frequency of a high frequency tone and a value obtained by doubling the frequency of a low tone frequency is the constant value $\Delta f$. It has already been known that simultaneous sounding of such two tones produces sway in the tones, i.e. beat, due to the frequency difference between the two tones. Accordingly, a constant beat is produced when a plurality of such tones in an octave relation, whether they are in a high frequency range or in a low frequency range, are simultaneously sounded.

It is an objective of the present invention to produce the above described modified scale as desired by digitally performing pitch controlling.

II. General construction

Figure 1:
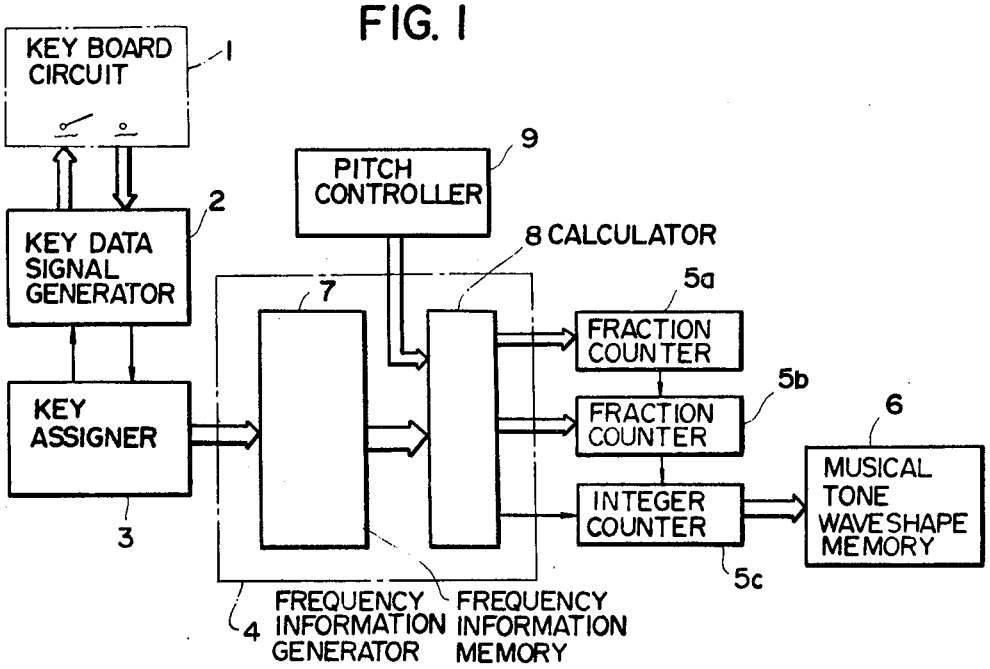
FIG. 1 is a block diagram showing one preferred embodiment of the electronic musical instrument according to the invention.

Referring first to FIG. 1 which shows one preferred embodiment of the electronic musical instrument according to the present invention, a keyboard circuit 1 has make contacts corresponding to respective keys. A key data signal generator 2 comprises a key address code generator which produces key address codes indicative of the notes corresponding to the respective keys successively and repeatedly. The key data signal generator 2 produces a key data signal when a make contact corresponding to a depressed key is closed and the key address code corresponding to the depressed key is produced. This key data signal is applied to a key assigner 3. The key assigner 3 comprises a key address code generator which operates in synchronization with the above described key address code generator, a key address code memory which is capable of storing a plurality of key address codes and successively and repeatedly outputting these key address codes and a logical circuit which, upon receipt of the key data signal, applies the key data signal to the key address code memory for causing it to store the corresponding key address code on the condition that this particular key address code has not been stored in any channel of the memory yet and that one of the channels of the memory is available for storing this key address code.

A frequency information generator 4 selectively produces nominal frequency information or modified frequency information corresponding to the depressed key upon receipt of the key address code. The frequency information consists of a fraction section and an integer section as will be described later and is applied to a frequency counter comprising fraction counters 5*a*, 5*b* and an integer counter 5*c*.

The fraction counter 5*a* is provided for cumulatively counting its inputs and applying a carry signal to the next fraction counter 5*b* when a carry takes place in the addition. The fraction counter 5*b* is of a like construction, applying a carry signal to the integer counter 5*c* when a carry takes place in the counter 5*b*.

The integer counter 5*c* cumulatively counts the carry signals and integer section information inputs and successively delivers out signals representing the results of the addition. The output signals of the integer counter 5*c* are applied to a plurality of input terminals of a waveshape memory 6. A musical tone waveshape for one period is sampled at $n$ points and the amplitudes of the sampled waveshape are stored at addresses 0 to $n$-1 of the waveshape memory 6. The musical tone waveshape is read from the waveshape memory 6 by successively reading out the amplitudes at the addresses corresponding to the output of the integer counter 5*c*.

If the frequency information is represented by F, the number of times per second F is counted in the frequency counter by A, and the number of sample points for one period of a musical tone waveshape by $n$, the frequency $f$ of the musical tone to be reproduced is $$f=\frac{A\times F}{n}\text{(Hz)} \tag{1}$$

Accordingly, the frequency information F is $$F=\frac{n}{A}\times f\ \text{(where } \frac{n}{A}\text{ is a constant)} \tag{2}$$

If nominal frequency information corresponding to nominal frequency $fx$ is represented by $Fx$, modified frequency information corresponding to modified frequency $fx-\Delta f$ is given by the following equation from the above equation (2):

$$\frac{n}{A}\times(fx-\Delta f)=Fx-(\frac{n}{A}\times\Delta f) \tag{3}$$

If difference in the value of frequency information between the nominal frequency and the modified frequency is represented by $\Delta$ F, $$\frac{n}{A}\times\Delta f=\Delta F \tag{4}$$

That is, the frequency $\Delta f$ between the nominal frequency and the modified frequency can be represented directly as the difference $\Delta$ F in the value of the frequency information.

Accordingly, the modified frequency information $Fx-\Delta$ F is obtained by subtracting the constant frequency information difference $\Delta$ F from the nominal frequency information $Fx$ Conversely, the nominal frequency information $Fx$ is obtained by adding the frequency information difference $\Delta$F to the modified frequency information $Fx-\Delta$ F.

The frequency information generator 4 comprises a frequency information memory 7 which stores frequency information corresponding to the respective key address codes or the modified frequency information (hereinafter referred to as "stored frequency information") and a calculator 8. The frequency information memory, upon receipt of a key address code from the key assigner 3, produces stored frequency information corresponding to the key address code. The calculator 8, upon receipt of the read out stored frequency information, conducts subtraction or addition and supplies the result of the calculation to the frequency counter.

A pitch controller 9 is provided for controlling supply of the frequency information difference $\Delta$ F to the calculator 8. Pitch frequency information corresponding to the frequency information difference $\Delta$ F is applied to the pitch controller 9 and outputting of desired pitch frequency information is controlled by operation of an operator. Depending upon whether the pitch frequency information is fed to the calculator 8 or not, the stored frequency information itself or the result of the calculation by the calculator 8 is selectively applied to the frequency counter. In response to the input to the frequency counter, the frequency counter selectively produces either the nominal frequency information or the modified frequency information.

For achieving the purpose of reproducing plurality of musical tones simultaneously, the present electronic musical instrument has a construction based on dynamic logic so that the counters, logical circuits and memories provided therein are used in a time-sharing manner. Accordingly, time relations between clock pulses controlling the operations of these counters etc. are very important factors for the operation of the present electronic musical instrument.

Figure 2:
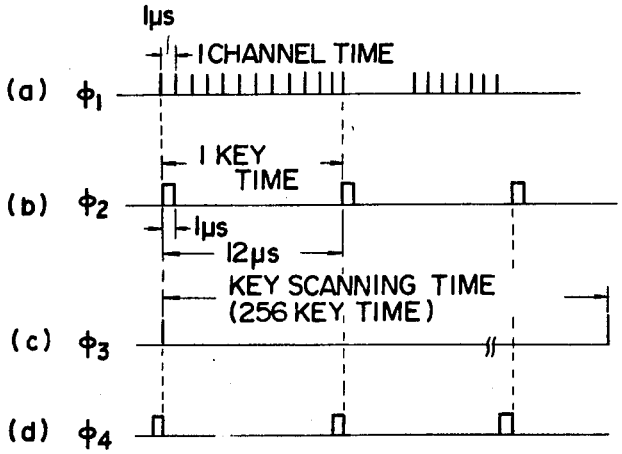
FIGS. 2(*a*) through 2(*d*) are respectively charts showing clock pulses employed in this embodiment of the electronic musical instrument.

Assuming that a maximum number of musical tones to be reproduced simultaneously is twelve, relations between the various clock pulses used in the present electronic musical instrument are illustrated in FIGS. 2(*a*) to 2(*d*). FIG. 2(*a*) shows a main clock pulse $\phi_1$ which has a pulse period of 1 $\mu$s. This pulse period is hereinafter referred to as "channel time" FIG. 2(*b*) shows a clock pulse $\phi_2$ having a pulse width of 1 $\mu$s and a pulse period of 12 $\mu$s, This pulse period of 12 $\mu$s is hereinafter referred to as "key time". FIG. 2(*c*) shows a key scanning clock pulse $\phi_3$ which has a pulse period equivalent to 256 key times. One key time is divided by 12 $\mu$s and each fraction of the divided key time is called first, second . . . twelfth channel respectively. FIG. 2(*d*) shows a clock pulse $\phi_4$ which appears only during the twelfth channel in each key time. A channel denotes in this specification a shared portion of time, i.e. the channel time.

III. Generation of key address codes

Figure 3:
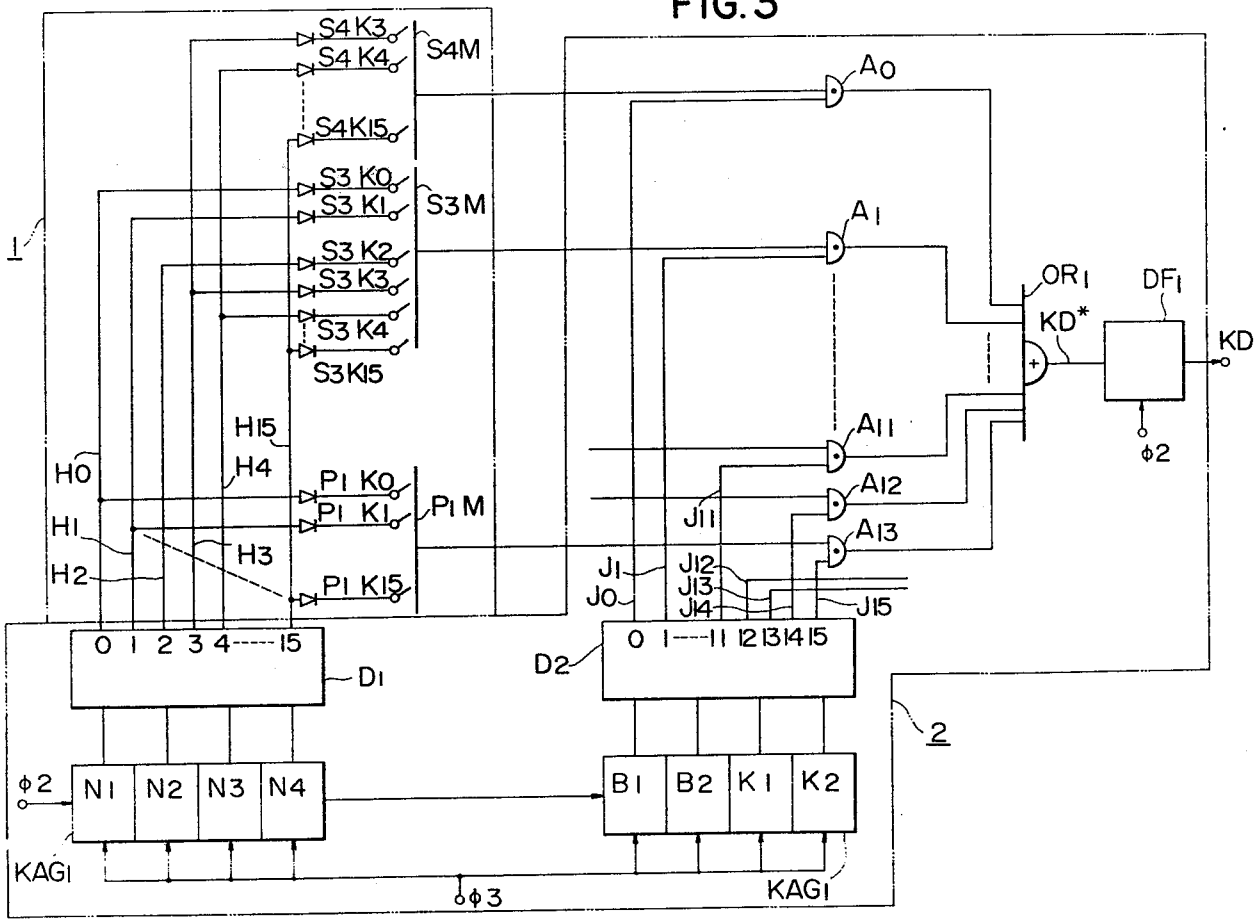
FIG. 3 is a circuit diagram showing a detailed logical circuit of a key data signal generator 2, shown in FIG. 2.

FIG. 3 shows the construction of the key data generator 2 in detail. A key address code generator $KAG_1$ consists of binary counters of eight stages. The clock pulse $\phi_2$ with the pulse period of 12 $\mu$s (hereinafter called a key clock pulse) is applied to the input of the key address code generator $KAG_1$. The key clock pulse applied to the key address code generator $KAG_1$ changes the code, i.e., the combination of 1 and 0 in each of the binary counter stages.

The highest class of electronic musical instrument typically has a solo keyboard, upper and lower keyboards and a pedal keyboard. The pedal keyboard has 32 keys ranging from $C_2$ to $C_4$ and the other keyboards respectively have 61 keys ranging from $C_2$ to $C_7$. Thus, this type of electronic musical instrument has 215 keys in all.

According to the present invention, 256 different codes are produced by the key address code generator $KAG_1$ and 215 codes among them are alloted to the corresponding number of keys. Digits of the key address code generator $KAG_1$ from the least significant digit up to the most significant digit are represented by reference characters $N_1$, $N_2$, $N_3$, $N_4$, $B_1$, $B_2$, $K_1$ and $K_2$ respectively. Among them, $K_2$ and $K_1$ constitute a keyboard code representing the kind of keyboard, $B_2$ and $B_1$ a block code representing a block in the keyboard and $N_1$ through $N_4$ a note code representing a musical note in the block. Each keyboard is divided into four blocks each including 16 keys. These blocks are designated as block 1, block 2, block 3 and block 4 counting from the lowest note side. It is assumed that the key address codes which would correspond to three notes above the actually existing highest key (note $C_6$ of block 4) in the solo keyboard S, upper keyboard U and lower keyboard L and the key address codes which would correspond to the blocks 3 and 4 in the pedal keyboard are not alloted to keys in the present embodiment.

The bit outputs of the key address code generator $KAG_1$ are applied through decoders to the keyboard circuit for sequentially scanning each key. The scanning starts from the block 4 of the solo keyboard S and is performed through the blocks 3, 2, 1 of the solo keyboards S, the blocks 4, 3, 2, 1 of the upper keyboard U, the blocks 4, 3, 2, 1 of the lower keyboard L and the blocks 2, 1 of the pedal keyboard P. One cycle of scanning of all of the keys is thereby completed and this scanning operation is cyclically repeated at an extremely high speed. Scanning time required for one cycle of scanning is $256 \times 12\ \mu s = 3.07$ ms.

Decoder $D_1$ is a conventional binary-to-one decoder designed to receive four-digit binary codes consisting of combinations of the digits $N_1$ to $N_4$ of the key address code generator $KAG_1$ and to deliver an output at one of the 16 individual output lines $H_0$ through $H_{15}$ successively and sequentially, the binary code in each instance determining a respective output line. The output line $H_0$ is connected through diodes to the key switches corresponding respectively to the highest note of each block (except the blocks 4) of the respective keyboards. The output line $H_1$ is similarly connected to the key switches corresponding to the second highest note of each block except the blocks 4. It will be understood that no keys are provided for the three codes on the highest note side in the block 4 of the solo keyboard S, the upper keyboard U and the lower keyboard L and, accordingly, the output lines $H_0$ to $H_2$ are not connected in the blocks 4. Output line $H_3$ and subsequent output lines are connected in a similar manner to the corresponding key switches of each block (also of block 4).

FIG. 3 illustrates connections between respective key switches and the output lines $H_0 - H_{15}$ with respect to the blocks 4 and 3 of the solo keyboard S and the block 1 of the pedal keyboard P. The first letter of the symbols used on the key switches designates the kind of the keyboard, the numeral affixed to the first letter the block number, and the numeral affixed to the letter K a decimal value of the corresponding one of the codes $N_1 - N_4$.

Each key switch has a make contact. One contact points thereof is individually connected as has been described above and the other contact point constitutes a common contact for each block. The common contact $S_1M - P_1M$ are respectively connected to AND circuits $A_0 - A_{13}$.

Decoder $D_2$ is a conventional binary-to-one decoder designed to receive four-digit binary codes consisting of combinations of the digits $B_1$, $B_2$, $K_1$ and $K_2$ of the key address code generator $KAG_1$ and to deliver an output at one of the 16 individual output lines $J_0$ through $J_{15}$ successively and sequentially, the binary code in each instance determining a respective output line. The output lines $J_0$ through $J_{15}$ (except $J_{12}$ and $J_{13}$) are connected to the inputs of the AND circuits $Y_0$ through $Y_{13}$ respectively. The outputs of the AND circuits $Y_0$ through $Y_{13}$ are connected through an OR circuit $OR_1$ to the input of a delay flip-flop circuit $DF_1$.

The codes produced from the key address code generator $KAG_1$ change their contents every time the key clock pulse $\phi_2$ is applied.

If a certain key is depressed, the make contact corresponding to the depressed key is closed. When the key address code generator $KAG_1$ provides a code which corresponds to the depressed key, an output "7" is produced from one of the AND circuits $A_0 - A_{13}$. This output is provided via an OR circuit $OR_1$. This output is a key data signal KD* which represents the closing of the make contact. This signal is delayed by the delay flip-flop $DF_1$ by one key time and provided therefrom. The key data signals KD*, KD are sequentially output with an interval of 3.07 ms as long as the make contact remains closed.

The foregoing description has been made with regard to a case where only one key is depressed. If a plurality of keys are depressed simultaneously, key data signals respectively corresponding to the depressed keys are produced in the same manner and different musical tone wave shapes respectively corresponding to these key data signals are obtained. For convenience of explanation, description will be made hereinbelow about a case where only one key is depressed to obtain one musical tone waveshape.

Figure 4:
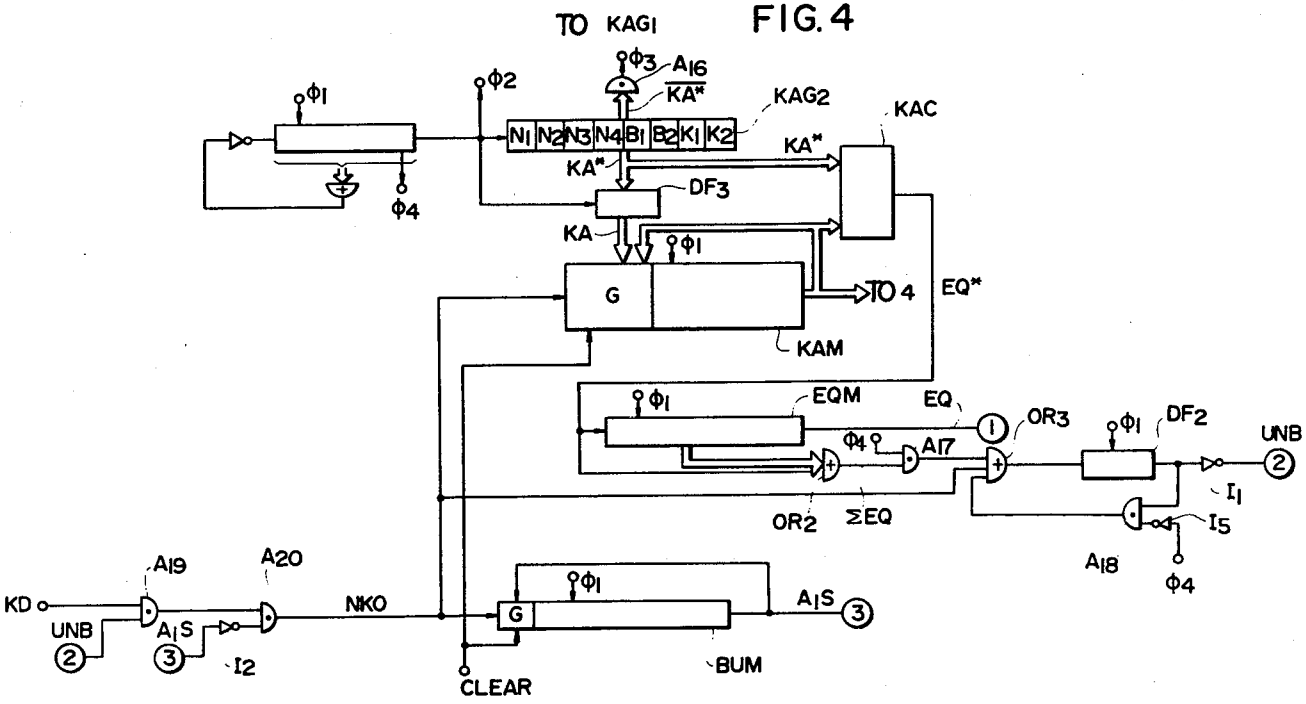
FIG. 4 is a circuit diagram showing a detailed logical circuit of a key assigner 3 shown in FIG. 1.

FIG. 4 is a block diagram showing the construction of the key assigner 3 in detail. A key address code memory KAM has memory channels of a number equal to that of the musical tones to be reproduced at the same time, each of these channels storing a key address code representing the musical note being played. The key address code memory KAM is adapted to apply the key address code in a time-sharing manner to the frequency information generator 4 as a frequency designation signal. In the present embodiment, a shift register of 12 words - 8 bits is utilized as the key address code memory KAM. This shift register performs shifting upon receipt of the main clock pulse $\phi_1$ produced at an interval of 1 $\mu$s. The output from the last stage of this shift register is provided to the frequency information memory and, simultaneously, fed back to its input side. Accordingly, each key address code is circulated in the shift register at a cycle of 1 key time (12 $\mu$s) unless the code is cleared from its corresponding channel.

A key address code generator $KAG_2$ is of the same construction as the key address code generator $KAG_1$. These two generators $KAG_1$ and $KAG_2$ operate in exact synchronization with each other. More specifically, the key clock pulse $\phi_2$ is used as input signals to both of the generators $KAG_1$ and $KAG_2$ and the fact that the respective bits of the key address code generator $KAG_2$ are all "0" is detected by an AND circuit $A_{16}$ and the detected signal $\phi_3$ is applied to the reset terminals of the respective bits of the key address code generator $KAG_1$ as the key scanning clock signal.

The key assigner 3 causes the key address code memory KAM to store a key address code corresponding to the key data signal KD upon receipt thereof when the following two conditions are satisfied:

Condition A; The key address code is not identical with any of the codes already stored in the key address code memory KAM.

Condition B; there is a not-busy channel, i.e. a channel in which no code is stored, in the key address code memory KAM.

Assume now that a key data signal KD* is produced from the OR circuit $OR_1$. At this time the key address code from the key address code generator $KAG_2$ coincides with the code of the key address code generator $KAG_1$ and represents the note of the depressed key. During the 12 $\mu$s period, the key address code KA* is applied to a comparison circuit KAC in which the code KA* is compared with each output of the channels of the key address code memory KAM. A coincidence signal EQ* produced from the comparison circuit KAC is "1" when there is coincidence and "0" when there is no coincidence. The coincidence signal EQ* is applied to a coincidence detection memory EQM and also to one input terminal of an OR circuit $OR_1$. This memory EQM is a shift register having a suitable number of bits, e.g. 12 as in this embodiment. The memory EQM successively shifts the signal EQ*, i.e. delays it by one key time when the signal EQ* is "1" and thereby produces a coincidence signal EQ (=1). Each of the outputs from the first to eleventh bits of the coincidence detection memory EQM is applied to the OR circuit $OR_2$. Accordingly, the OR circuit $OR_2$ produces an output when either the signal EQ* from the comparison circuit KAC or one of the outputs from the first to eleventh bits of the shift register EQM is "1". The output signal $\Sigma$ EQ of the OR circuit $OR_2$ is applied to one of the input terminals of an AND circuit $A_{17}$. The AND circuit $A_{17}$ receives a clock pulse $\phi_4$ at the other input terminal thereof. Since information stored in the shift register before the first channel is false information, correct information, i.e. information representing the result of comparison between the key address code KA* and the codes in the respective channels of the key address code memory KAM is obtained only when the result of the comparison in each of the first to eleventh channels is applied to the coincidence detection memory EQM and the result of comparison in the twelfth channel is applied directly to the OR circuit $OR_2$. This is the reason why the clock pulse $\phi_4$ is applied to the AND circuit $A_{17}$.

If the signal $\Sigma$ EQ is "1" when the clock pulse $\phi_4$ is applied, the AND circuit $A_{17}$ produces an output "1" which is applied through an OR circuit $OR_3$ to a delay flip-flop $DF_2$. The signal is delayed by this delay flip-flop $DF_2$ by one channel time and fed back thereto via an AND circuit $A_{18}$. Thus, the signal "1" is stored during one key time until a next clock pulse $\phi_4$ is applied to the AND circuit $A_{18}$ through an inverter $I_5$. The output "1" of the delay flip-flop $DF_2$ is inverted by an inverter $I_1$ and is provided as an unblank signal UNB. This unblank signal UNB indicates that the same code as the key address code KA* is not stored in the key address code memory KAM when it is "1", and that the same code as the key address code KA* is stored in the memory KAM when it is "0".

As described in the foregoing, presence of the condition A is examined during production of the key data signal KD*. In other words, whether the key data signal is an old signal which has already been stored or a new one which has not been stored in the memory is examined. The unblank signal UNB which indicates the result of the examination is applied to one input terminal of an AND circuit $A_{19}$ during the next one key time. The key data signal KD is delayed by one key time and applied to the other input terminal of the AND circuit $A_{21}$. Accordingly, whether a key address code corresponding to the key data signal KD is stored in the memory KAM is examined by one key time immediately before the application of the key data signal KD is applied to one of the input terminals of an AND circuit $A_{20}$ via the AND circuit $A_{19}$. When the unblank signal UNB is "0", the key data signal KD is not gated out of the AND circuit $A_{19}$.

In order for new key address code to be stored in the key address code memory KAM, at least one of the twelve channels of the memory must be in a not-busy state, i.e. available for storage. A busy memory BUM is provided to detect whether there is a not-busy channel in the key address code memory. The busy memory BUM consists of a shift register of 12 bits, and is adapted to store "1" when a new key-on signal NKD is applied thereto from an AND circuit $A_{20}$. This signal "1" is sequentially and cyclicly shifted in the busy memory BUM. This new key-on signal is simultaneously applied to the key address code memory KAM so as to cause the memory KAM to store the new key address code. Accordingly, the signal "1" is stored in one of the channels of the busy memory BUM corresponding to the busy channel of the key address code memory KAM. Contents of a not-busy channel are "0". Thus, the output of the final stage of the busy memory BUM indicates whether this channel is busy or not. This output is hereinafter referred to as a busy signal $A_1S$.

This busy signal $A_1S$ is applied to one of the input terminals of the AND circuit $A_{20}$ via an inverter $I_2$. When the signal $A_1S$ is "0", i.e., a certain channel is not busy the key data signal is applied to the busy memory BUM as the new key-on signal via the AND circuit $A_{20}$ thereby causing the busy memory BUM to store "1" in its corresponding channel. Simultaneously, the gate G of the key address code memory KAM is controlled so that the key address code KA from a delay flip-flop $DF_3$ will be stored in a not-busy channel of the memory KAM.

The delay flip-flop $DF_3$ is provided for delaying the output KA* of the key address code generator KAG by one key time so that a key address code corresponding to the key data signal KD may be stored in synchronization with the key data signal KD, since the key data signal KD* which is delayed by one key time is applied to the key assigner.

The new key-on signal NKO from the AND circuit $A_{20}$ is applied through the OR circuit $OR_3$ to the delay flip-flop $DF_2$ to set the flip-flop, the unblank signal UNB becomes "0" Accordingly, the output of the AND circuit $A_{19}$ becomes "0" when the unblank signal UNB becomes "0" thereby changing the new key-on signal NKO to "0". This arrangement is provided to ensure storage of the key address code KA in only one, and not two or more, not-busy channel of the key address code memory KAM.

In this way, 12 kinds of key address codes are stored in the key address code memory KAM, and these address codes are shifted by the main clock pulse $\phi_1$ and the output of the final stage are successively applied to the frequency information generator 4 and also fed back to the input side of the memory KAM for cyclically producing outputs therefrom changing at a rate of 1 $\mu$s, i.e. the same code appearing once every 12 $\mu$s.

It should be noted that the key address codes $N_1$–$B_2$ representing the notes applied to the frequency information memory and the key address codes $K_1$, $K_2$ representing the keyboards are utilized as desired for controlling a musical tone for each keyboard.

IV. Pitch controlling

Figure 5:
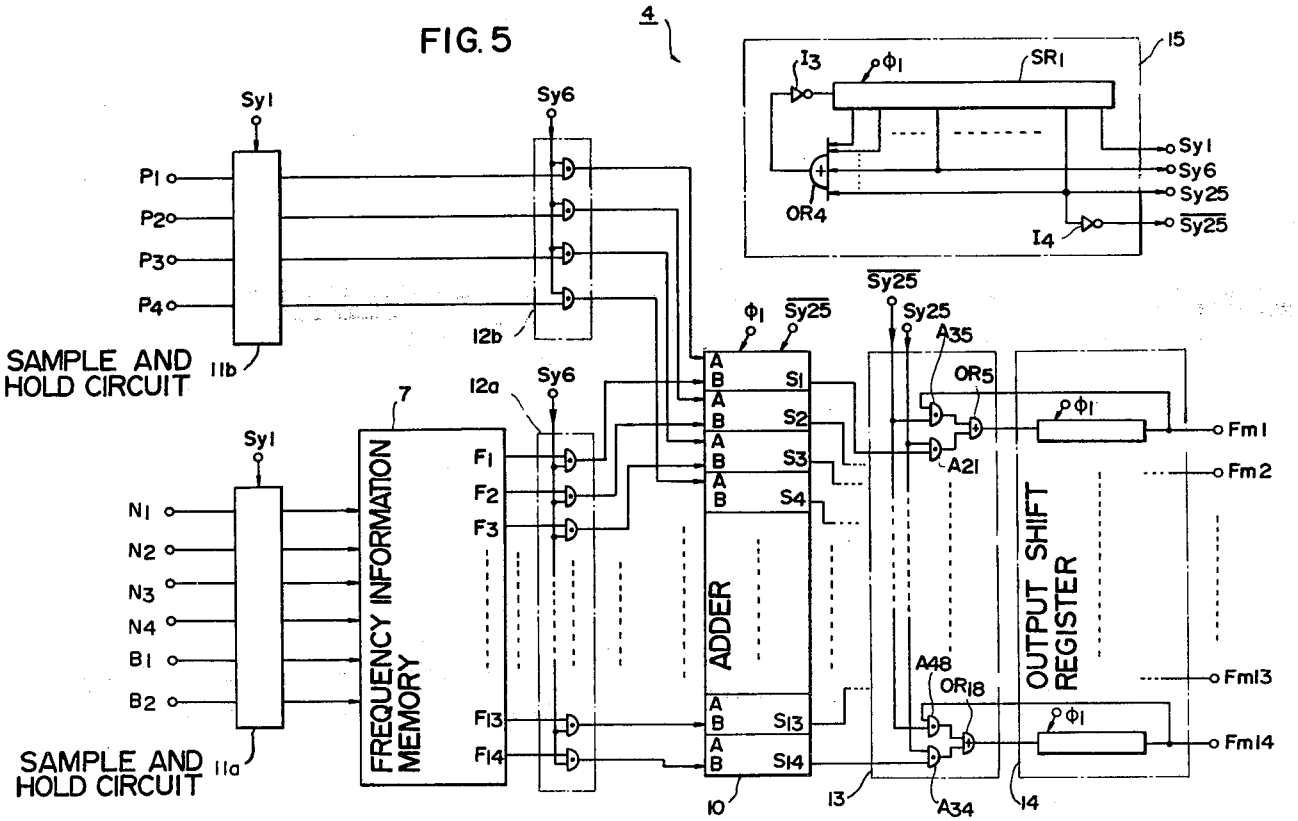
FIG. 5 is a block diagram showing in detail a frequency information generator 4 shown in FIG. 1.

FIG. 5 shows an example of the frequency information generator 4. In this example, an adder 10 is employed as a calculating device.

The frequency information memory 7 stores modified frequency information corresponding to the respective key address codes as the stored frequency information and produces modified frequency information $F_1 - F_{14}$ for a particular key address code (a combination selected from $N_1$, $N_2$, $N_3$, $N_4$, $B_1$ and $B_2$) when this key address code is applied thereto.

The frequency information to be stored consists of a suitable number of bits, e.g. 14 as in the present embodiment. One bit of the most significant digit represents an integer section and the rest of the bits, i.e. 13, represent a fraction section. The following Table I illustrates example of the modified frequency information corresponding to the key address codes of keys $A_1$ – $A_5$ ,$B_5$ and $C_6$. In the table, the F-number represents the frequency information $F_1 - F_{14}$ expressed in a decimal notation, with the most significant digit $F_{14}$ being placed in the integer section.

Table I

| | Modified frequency information $F_1 - F_{14}$ | | | | | | | | | | | | | | |
|---|---|---|---|---|---|---|---|---|---|---|---|---|---|---|---|
| | Binary fraction section | | | | | | | | | | | | | | |
| key | 14 | 13 | 12 | 11 | 10 | 9 | 8 | 7 | 6 | 5 | 4 | 3 | 2 | 1 | F-number |
| $C_6$ | 1 | 1 | 1 | 0 | 1 | 0 | 0 | 0 | 0 | 1 | 0 | 0 | 0 | 1 | 1.814575 |
| $B_5$ | 1 | 1 | 0 | 1 | 1 | 0 | 1 | 1 | 0 | 1 | 0 | 0 | 0 | 1 | 1.713012 |
| $A_5$ | 1 | 1 | 0 | 0 | 1 | 1 | 1 | 1 | 0 | 0 | 0 | 0 | 0 | 1 | 1.617309 |
| $A_5$ | 1 | 1 | 0 | 0 | 0 | 0 | 1 | 1 | 0 | 1 | 0 | 0 | 0 | 1 | 1.525512 |
| $A_4$ | 0 | 1 | 1 | 0 | 0 | 0 | 0 | 1 | 1 | 0 | 0 | 0 | 0 | 1 | 0.761840 |
| $A_3$ | 0 | 0 | 1 | 1 | 0 | 0 | 0 | 0 | 1 | 0 | 1 | 0 | 0 | 1 | 0.380004 |
| $A_2$ | 0 | 0 | 0 | 1 | 1 | 0 | 0 | 0 | 0 | 0 | 1 | 1 | 0 | 1 | 0.189086 |
| $A_1$ | 0 | 0 | 0 | 0 | 1 | 0 | 1 | 1 | 1 | 1 | 1 | 1 | 1 | 1 | 0.093627 |

Figure 6:
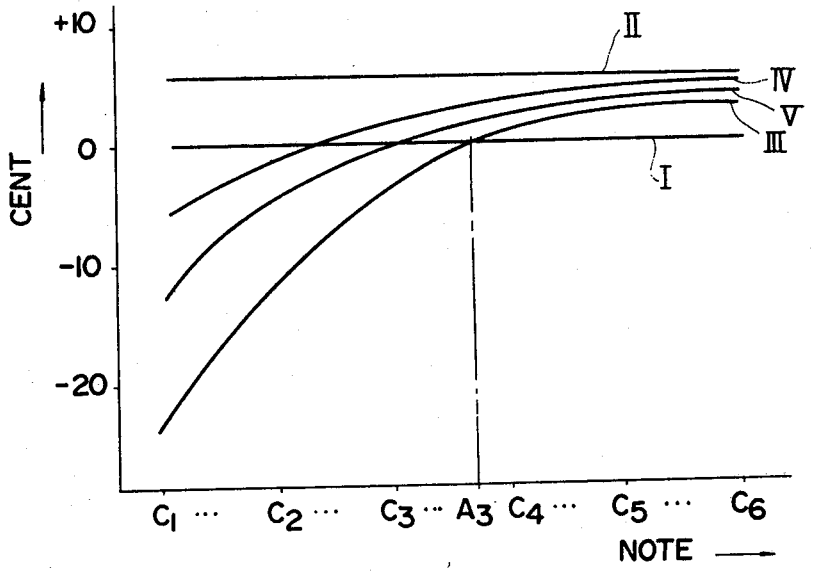
FIG. 6 is a graphic diagram illustrative of a relation between the nominal scale and the modified scale.

The modified frequency information $F_1 - F_{14}$ is determined in the following manner:

First, nominal frequency information in the nominal scale is obtained with respect to each note by using the above described equation (2). The nominal scale in this case need not be 12 equal temperament with the frequency of 440 Hz for the note $A_3$ being used as a standard pitch. In the present embodiment, the nominal scale is determined at a value which is several cents above the scale according to 12 equal temperament for improving tone quality of the modified scale. Human hearing can hardly distinguish the pitch difference of the order of several cents and the tone quality of the nominal scale is not impaired by such pitch difference. The interval of tones in octave relation in the nominal scale, however, must be in an exact harmonic overtone relation. FIG. 6 schematically shows the interval of the nominal scale (line II) used in the present embodiment with the frequencies of the respective notes according to equal temperament being taken as reference frequencies (line I representing 0 cent). One cent is one hundredth of demiton in the equally tempered scale.

In the equation (2), A representing the number of times per second F is counted as 1/one key time. If one key time is a ($\mu$s), $$A = \frac{1}{a} \times 10^6.$$

Let us further assume that the sampling number $n$ in the waveshape memory 6 is 64 and the constant $$\frac{n}{A}$$

thus obtained is 0.00086365. The nominal frequency information $F_x$ in relation to the nominal frequency $fx$ is $$Fx = 0.00086365 \times fx \quad (5)$$

If a desired frequency difference $\Delta f$ is selected at 2.1 Hz, the frequency information difference $\Delta$ F is $$\Delta F = 0.00086365 \times 2.1 = 0.00181366 \quad (6)$$

From the above equations (3) and (4), the F-number of the modified frequency information $F_1 - F_{14}$ is obtained by the following equation:

$$\text{F-number} = Fx - 0.00181366 \quad (7)$$

That is, the F-number is a value obtained by subtracting the constant value F uniformly from the nominal frequency information F$x$.

Modified frequency information obtained by the equation (7) is stored in the memory 7 as shown in Table 1. The interval of the modified scale determined in this manner is as shown by line III in FIG. 6. The pitch is 0 cent at the note $A_3$ and is somewhat high in the notes of higher frequencies and becomes gradually lower in the notes of lower frequencies. Such scale has a desirable tone quality resembling that of the tempered scale of a piano.

The stored frequency information from the frequency information memory 7, i.e. the modified frequency information $F_1 - F_{14}$ in the present embodiment, is applied to the adder 10 as summand. On the other hand, pitch frequency information $P_1 - P_4$ is applied from the pitch control section 9 as addend.

In order to achieve the selective production of the modified frequency information and the nominal frequency information, the pitch frequency information $P_1 - P_4$ must at least be the same value as the frequency information difference $\Delta$ F.

Accordingly, as the pitch frequency information $P_1 - P_4$, F in the equation (6), for example, is the maximum value. Since $\Delta$ F in the equation (6) is expressed in a decimal notation the first order of which corresponds to the fourteenth digit of a binary notation, if the first digit thereof is made the first order, $$0.00181366 \times 2^{13} = 15 \quad (8)$$

Accordingly, the pitch frequency information $P_1 - P_4$ is expressed by a binary numerical value of four digits.

It will be readily understood from the equation (7) that the result of addition in the adder 10 becomes the nominal frequency information Fx when the pitch frequency information $P_1 - P_4$ is 1111. When the pitch frequency information $P_1 - P_4$ is 0000, the stored frequency information $F_1 - F_{14}$ is directly output as the result of addition. In the present embodiment, pitch controlling up to sixteen different values can be obtained, because not only the modified frequency information from the memory 7 but also fifteen kinds of modified frequency information at the maximum can be produced in accordance with the pitch frequency information $P_1 - P_4$. More specifically, if the stored frequency information $F_1 - F_{14}$ is represented as $F_x - F$ from the equation (7), the result of addition output from the adder 10, i.e. By which is the value of the pitch controlled frequency information $F_{m1} - F_{m14}$, is determined by the following equation in accordance with a value $\Delta$ Fy of the pitch frequency information $P_1 - P_4$:

$$Fy = Fx - \Delta F + \Delta Fy \quad (1)$$

Accordingly, when the pitch frequency information $P_1 - P_4$ is $\Delta$ F, the nominal frequency information F$x$ is obtained as the result of addition. When $P_1 - P_4$ is 0, the modified frequency information $F_1 - F_{14}$ is obtained, and, when $P_1 - P_4$ is $\Delta$ F$a$ ($0 < \Delta Fa < \Delta F$), other modified frequency information is obtained.

The pitch control section 9 comprises an operator for establishing desired pitch frequency information $P_1 - P_4$ and a matrix circuit for converting a signal sent from the operator into the pitch frequency information $P_1 - P_4$. In case the beat effect is desired separately for each keyboard or different frequency difference $\Delta f$ is desired for each keyboard, the operator and the matrix circuit are provided for each keyboard and, in addition thereto, a data select circuit for selectively outputting the pitch frequency information $P_1 - P_4$ established for the respective keyboards in response to the keyboard code $K_1K_2$ applied from the key assigner 3.

Figure 7:
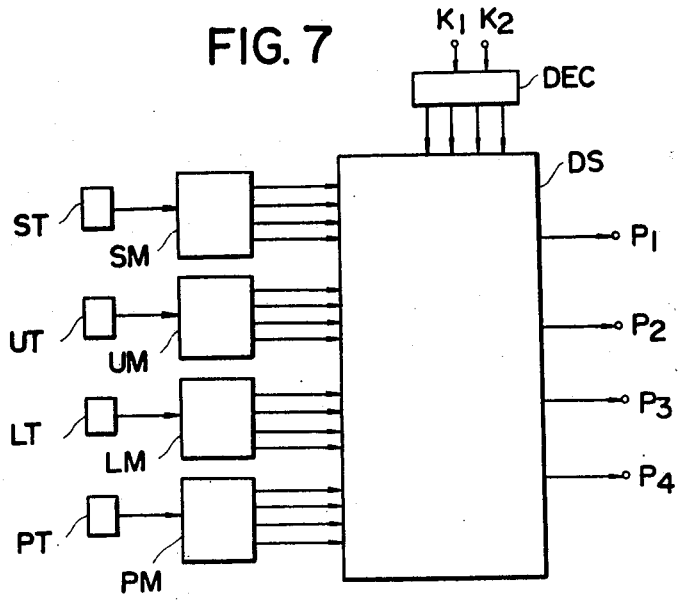
FIG. 7 is a block diagram showing an example of a circuit for producing pitch frequency information corresponding to the kind of keyboard including the depressed key.

In the embodiment shown in FIG. 7, operators ST, UT, LT, and PT and matrix circuits SM, UM, LM and PM are respectively provided for their corresponding keyboards, i.e. the solo keyboard, upper keyboard, lower keyboard and pedal keyboard, and the pitch frequency information $P_1 - P_4$ established for the respective keyboards by the operators ST – PT is supplied from the matrix circuits SM – PM to a data select circuit DS. The data select circuit DS also receives the output of a decoder DEC corresponding to the keyboard code $K_1$ $K_2$ and selectively outputs the pitch frequency information $P_1 - P_4$ corresponding to the keyboard code $K_1K_2$ (i.e. one of the matrix circuit outputs) in response to the output of the decoder DEC. If, for example, the decoder output corresponding to the keyboard code $K_1K_2$ representing the upper keyboard is applied to the data select circuit DS, the output $P_1 - P_4$ of the matrix circuit UM for the upper keyboard is selected and applied to the frequency information generator 4.

Any conventional digital type adder may be employed as the adder 10. In the present embodiment, a parallel type adder which receives at input terminals B the stored frequency information $F_1 - F_{14}$ from the memory 7 as summand and, at input terminals A for four less significant digits, the pitch frequency information $P_1 - P_4$ from the pitch control section 9 as addend. A register for temporarily storing the output of each digit of the adder 10 and a register for temporarily storing (for 1 $\mu$s) a carry signal may be additionally provided. In this case, an intermediate result of addition in the first register is circulatingly input to the adder 10 every 1 $\mu$s in response to the main clock pulse $\phi_1$ and is added to the carry signal applied from the second register. The result of addition $S_1 - S_{14}$ is applied to the output shift register 14 via the gate circuit 13.

Figure 8:
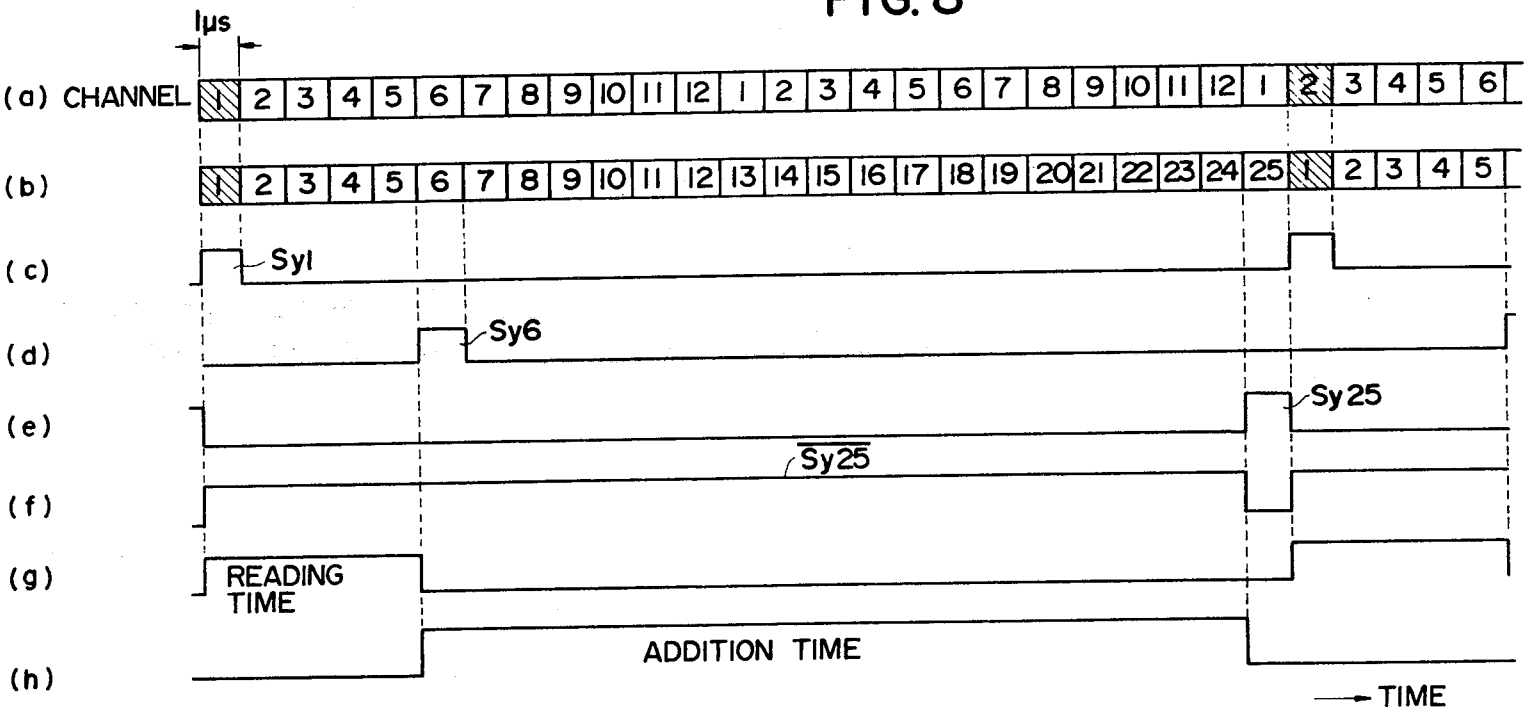
FIGS. 8(*a*) through 8(*h*) are timing charts illustrative of signals showing a detailed circuit at respective points in the frequency information generator 4.

In constructing the frequency information generator 4, operation time of the frequency information memory 7 constructed of a suitable conventional memory such as a read-only memory as well as time required for addition in the adder 10 must be taken into consideration. For achieving an accurate operation it is indispensable that time required for addition by synchronized with the operation of the entire system. According to the invention, a synchronization signal generation circuit 15 is provided for synchronization between the component parts of the system. Assume now that a maximum number of musical tones to be reproduced simultaneously is 12. The synchronizing signal generation circuit 15 comprises a one-input-parallel output type shift register $SR_1$ with 25 bits, an OR gate $OR_4$ receiving outputs of the first to the 24th bits of the shift register $SR_1$ and inverters $I_3$ and $I_4$. The contents in the shift register $SR_1$ are shifted by the clock pulse $\phi_1$ every 1 $\mu$s and the output from the 5th bit is used as the synchronizing pulse Sy 6, the one from the 24th bit as the synchronizing pulse Sy 25 and the one from the 25th bit as the synchronizing pulse Sy 1 respectively. Relationship between the respective pulses Sy 1, Sy 6, Sy 25, Sy 25 are illustrated in FIGS. 8 (C) through (*f*). FIG. 8 (*a*) shows the channel time.

A sample and hold circuit 11*a* holds the key address code $N_1 - B_2$ in storage during one pulse period of the synchronizing pulse Sy 1 (i.e. 25 $\mu$s) and supplies stored key address code to the frequency information memory 7 until a next pulse Sy 1. A sample hold circuit 7*b* likewise holds pitch frequency information $P_1 - P_4$ in storage during one pulse period of the synchronizing pulse Sy 1 and supplies information $P_1 - P_4$ to a second gate circuit 12*b* to be described later until a next pulse Sy 1.

A first gate circuit 12*a* is composed of a plurality of AND circuits each of which receives at one input thereof, a corresponding one of the bit outputs $F_1 - F_{14}$ of the frequency information memory 7 and, at the other input thereof, the synchronizing pulse Sy 6. The second gate circuit 12*b* is likewise composed of a plurality of AND circuits each of which receives, at one input thereof, a corresponding one of the bit outputs $P_1 - P_4$ of the sample hold circuit 11*b*. These gate circuits 12*a* and 12*b* supply, upon application thereto of the synchronizing pulse Sy 6, the frequency information $F_1 - F_{14}$ and the pitch frequency information $P_1 - P_4$ to the adder 10 respectively as summand inputs and addend inputs. Since the interval between the synchronizing pulses Sy 1 and Sy 6 is 5 $\mu$s, reading of the memory 7 may be completed within 5 $\mu$s as shown in FIG. 8(*g*). Accordingly, the operation time of the memory 7 is sufficiently secured. Further a read-only memory of a low speed may sufficiently be employed as the memory 7 so that the memory 7 may be made very compact and manufactured at a low cost.

A third gate circuit 13 comprises AND circuits $A_{21} - A_{34}$ each of which receives at one input thereof a corresponding bit output of the adder 10 and at the other input thereof the synchronizing pulse Sy 25, AND circuits $A_{35} - A_{48}$ each from the final state of a corresponding shift register of an output shift register group 14 and, at the other input thereof, the signal Sy 25 which is of an opposite polarity to the synchronizing pulse Sy 25, and OR circuits $OR_5 - OR_{18}$ each of which receives the outputs of corresponding ones among the AND circuits $A_{21} - A_{34}$ and $A_{35} - A_{48}$. When the third gate circuit 13 receives the synchronizing pulse Sy 25, it applies signals $S_1 - S_{14}$ representing the results of the addition conducted in the adder 10 (i.e. pitch controlled frequency information $F_{m1} - F_{m14}$) to the respective inputs of the shift register of the output shift register group 14. When the synchronizing pulse Sy 25 is not applied to the third gate circuit 13, the output data of the shift register group 14 is circulated.

Since interval between the synchronizing pulse Sy 6 and Sy 25 is 19 $\mu$s as shown in FIG. 8 (*h*), the operation of adder 10 is sufficiently secured. The signal Sy 25 is provided for resetting the result of addition.

Each shift register of the output shift register group 14 has 12 words (each word consisting of 14 bits) and is successively shifted by the clock pulse $\phi_1$. The output shift register group 14 is provided for outputting the result of addition $S_1 - S_{14}$ for a plurality of channels in a time sharing sequence manner. As shown in FIG. 8(*a*) which illustrates the respective channel times and FIG. 8(*b*) which illustrates a period of generation of the synchronizing pulses, the key address code $N_1 - B_2$ and the pitch frequency information $P_1 - P_4$ are respectively stored in the sample hold circuits 11*a* and 11*b* in the order of the first channel, second channel . . . every time the synchronizing pulse Sy 1 is applied to these sample hold circuits 11*a* and 11*b*.

In response to this the result of the addition for each channel (i.e. each key or tone) conducted in the adder 10 are sequentially output therefrom with an interval of 25 $\mu$s per channel (i.e. one key or one tone). Accordingly, it takes 300 $\mu$s before the results of the addition for all of the 12 channels have been output from the adder 10. Accordingly, the output of the final stage of each of the output shift register group 14 is fed back and the data for a particular channel is circulated every one key time for enabling the shift register group 14 to supply every one key time the result of addition $S_1 - S_{14}$ for the particular channel to the frequency counters 5*a* – 5*c* as the pitch controlled frequency information $F_{m1} - F_{m14}$. New data is stored in the particular channel every 300 $\mu$s.

Assume that the operator of the pitch control section 9 has four set position. If this operator is set at a set position at which no octave beat effect is produced (hereinafter referred to as "position 1P"), frequency difference of 21 Hz is added to the stored frequency, so that the pitch frequency information $P_1 - P_4$ is 1111 and the frequency information $F_{m1} - F_{m14}$ produced from the output shift register group 14 is the nominal frequency information (i.e. a value obtained by adding 111 to the four less significant digits of the stored frequency information $F_1 - F_{14}$ shown in Table I). If the operator is set at a set position at which a slight octave beat effect is produced by frequency difference in the order of 0.7 Hz (hereinafter referred to as "position 2P"), frequency difference of 1.4 Hz is added. The pitch frequency information $P_1 - P_4$ is 1010 counting from the most significant digit as will be apparent from the equations (6) and (8). Accordingly, the frequency information $F_{m1} - F_{m4}$ is modified frequency information obtained by adding 1010 to the four less significant digits of the stored frequency information $F_1 - F_{14}$ shown in Table I: If the operator is set at a position at which an octave beat effect is produced by frequency difference in the order of 1.4 Hz (hereinafter referred to as "positions 3P"), frequency difference of 0.7 Hz is added. The pitch frequency information $P_1 - P_4$ is 0101 counting from the most significant digit, and modified frequency information obtained by adding 0101 to the stored frequency information $F_1 - F_{14}$ is produced. If the operator is set at a set position at which an octave beat effect is produced by frequency difference in the order of 2.1 Hz is produced (hereinafter referred to as "position 4P", the pitch frequency information $P_1 - P_4$ is 0000 as will be apparent from the equation (7). In this case, the stored frequency information $F_1 - F_{14}$ is directly output as the modified frequency information.

In the above described manner, the modified frequency information or the nominal frequency information is selectively output from the frequency information generator 4 in accordance with the value of the pitch frequency information $P_1 - P_4$.

V. Generation of a musical tone waveshape

Figure 9:
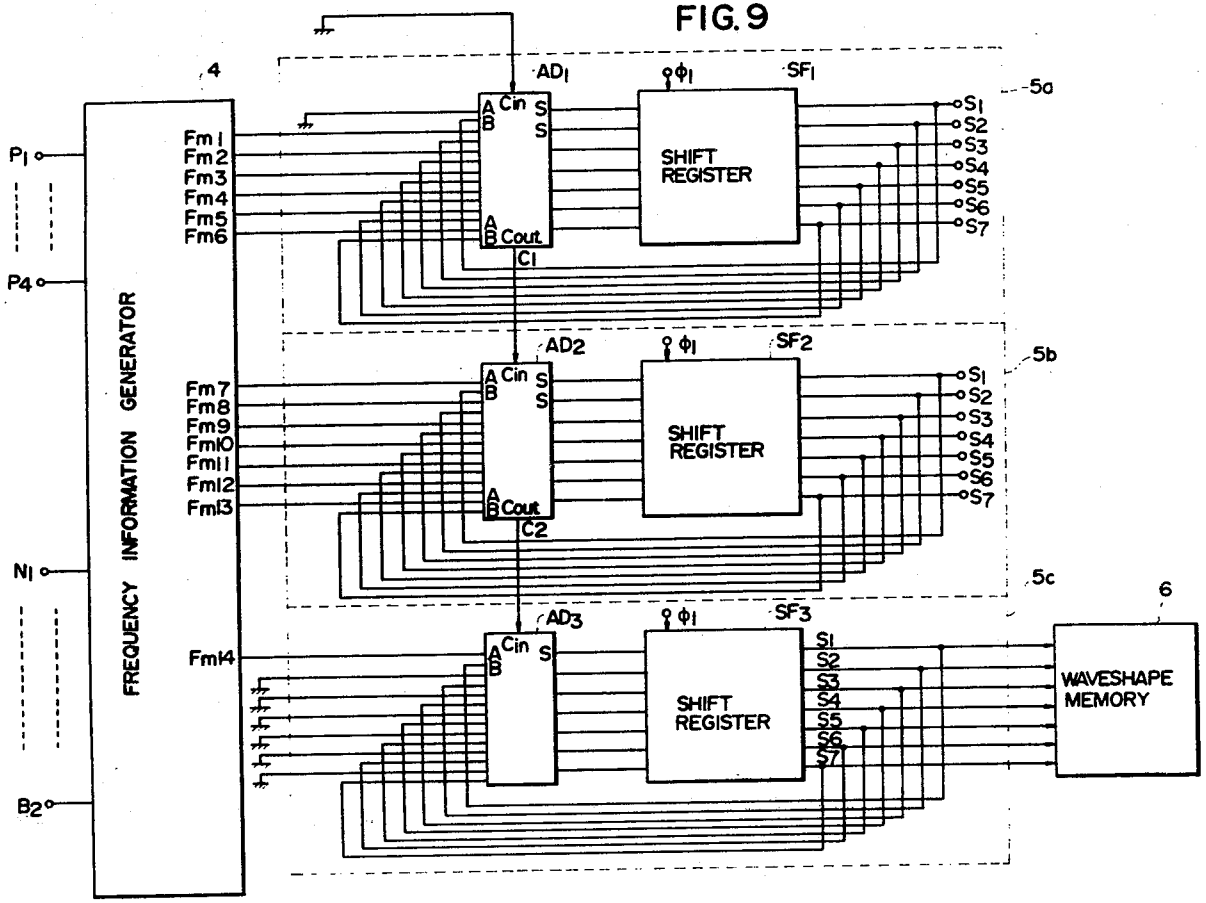
FIG. 9 is a circuit diagram showing a detailed circuit of fraction and integer counters shown in FIG. 1.

The least significant digit up to the sixth digit of the frequency information $F_{m1} - F_{m14}$ are applied from the output shift register group 14 to the fraction counter 5*a*, those from the seventh digit up to the thirteenth digit to the fraction counter 5*b*, and the most significant digit to the integer counter 5*c* respectively. The counters 5*a* – 5*c* comprise adders $AD_1 - AD_3$ and shift register $SF_1 - SF_3$ as shown in FIG. 9. Each of the adders $AD_1 - AD_3$ adds the output from the corresponding one of the shift registers $SF_1 - SF_3$. The shift registers $SF_1 - SF_3$ are adapted to store the 12 kinds of outputs in time sequence from the adders $AD_1 - AD_3$ temporarily and feed them back to the input side of the adders $AD_1 - AD_3$. The shift register $SF_1 - SF_3$ respectively have the same number of stages as the maximum number of musical tones to be reproduced simultaneously, e.g. 12 as in the present embodiment. This is an arrangement made for operating the frequency counters in a time-sharing sequence manner, since the frequency information memory 4 receives in time sharing the key address code stored in the 12 channels (shift register stages) of the key address code memory KAM and produces the frequency information for the respective channels.

Explanation will now be made about this arrangement with respect to the first channel. If the contents of the first channel of the shift register $SF_1$ of the fraction counter 5*a* are "0", frequency information signals $F_{m1}$ through $F_{m6}$ i.e. the first 6 bits of the fraction section are initially stored in the first channel of the shift register $SF_1$. After a lapse of one key time, new frequency information signals $F_{m1}$ through $F_{m6}$ are added to the contents already stored in the first channel. This addition is repeated at every key time and the signals $F_{m1}$ through $F_{m6}$ are cumulatively added to the stored contents. When a carry takes place in the addition, a carry signal $C_{10}$ is applied from the counter 5*a* to the next counter 5*b*. The fraction counter 5*b* consisting of the adder $AD_2$ and the shift register $SF_2$ likewise makes cumulative addition of frequency information signals $F_{m7}$ through $F_{m13}$ i.e. the next 7 bits of the fraction section, and the carry signal $C_{10}$ applying a carry signal $C_{20}$ to the adder $AD_3$ when a carry takes place as a result of the addition. The integer counter 5*c* consisting of the adder $AD_3$ and the shift register $SF_3$ receives the single digit $F_{m14}$ and the carry signal $C_{20}$ from the adder $AD_2$ and makes cumulative addition in the same manner as has been described with respect to the fraction counters 5*a* and 5*b*. The integer outputs of 7 bits stored in the first channel of the shift register $SF_3$ are successively applying to the musical tone waveshape memory for designating the reading addresses to read. If one period of a musical tone waveshape to be reproduced is stored in the form of sample points with a sampling number $n = 64$, the integer counter 5*c* is composed in such a manner that it has 64 stages and reading of said one period of waveshape is completed when a cumulative value of the frequency informaion $F_{m1} - F_{m14}$ has amounted to 64.

If the operator of the pitch control section 9 is set at the position 1P, a musical tone reproduced from the waveshape memory 6 is in the nominal scale as shown by a line II in FIG. 6, and no octave beat effect is produced. If the operator is set at the position 2P, a musical tone in the modified scale is reproduced as shown by a line IV in FIG. 6, and an octave beat effect in the order of 0.7 Hz is produced. At the position 3P, a musical tone in the modified scale as shown by a line V is reproduced, and an octave beat effect in the order of 1.4 Hz. At the position 4P, a musical tone in the modified scale as shown by a line III is reproduced, and an octave beat effect in the order of 2.1 Hz is produced. Taking the note A at the frequencies of the reproduced tones are:

| | | |
|---|---|---|
| $A_1$ ... 108.4 Hz, | $A_2$ ... 218.93 Hz, | $A_3$ ... 440 Hz, |
| $A_4$ ... 882.1 Hz, | $A_5$ ... 1766.3 Hz. | |

Accordingly, when a plurality of such tones which are in an octave relation are reproduced simultaneously, a constant beat (2.1 Hz) is produced regardless of the magnitude of frequency. This beat produces a very pleasant musical effect.

Figure 10:
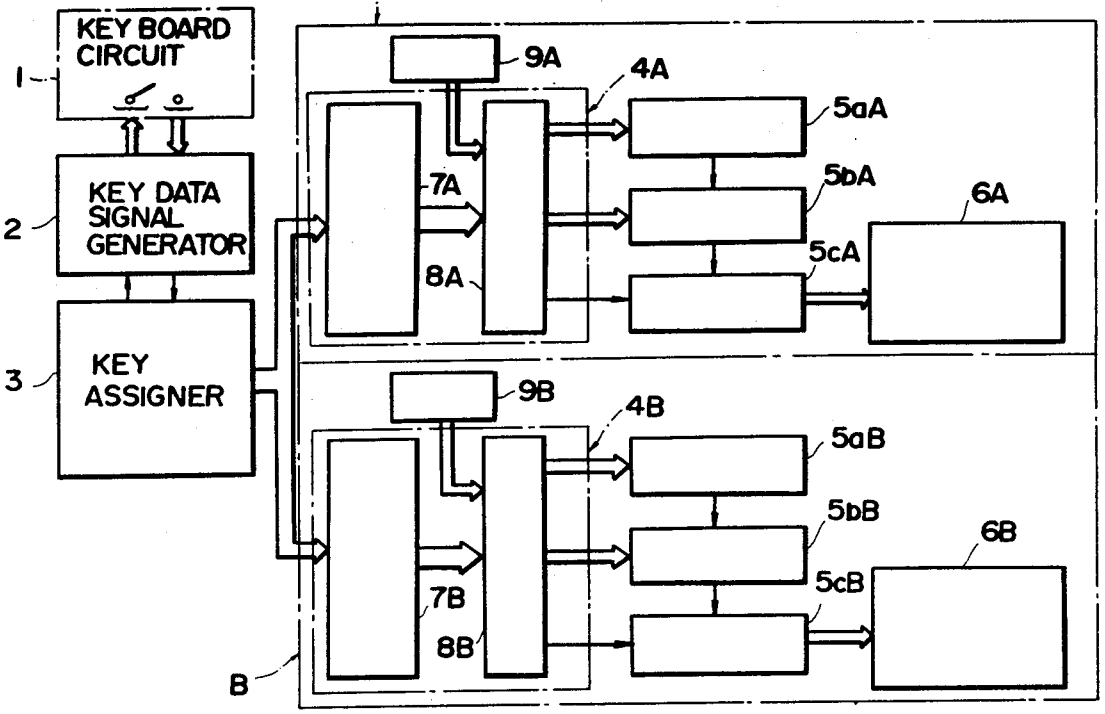
FIG. 10 is a block diagram showing another embodiment of the electronic musical instrument according to the invention.

FIG. 10 shows another embodiment of the electronic musical instrument according to the invention. In this embodiment, a plurality of musical tone waveshape production system are provided and musical tones which are of the same note but have slightly different frequencies are produced in these systems. This slight difference in frequency produces a sway in the tone reproduced and thereby provides a beat effect. This is the single key beat effect. It will be understood that the octave beat effect are also produced between the tones in octave relation in this embodiment. In the embodiment shown in FIG. 10, two systems A and B are provided.

In the embodiment shown in FIG. 10, a keyboard circuit 1, a key-date generator 2 and a key assignor 3 are of the same construction as those employed in the previously described embodiment. The circuit subsequent to the key assigner 3 is divided in the two systems A and B.

The musical tone waveshape production system A and B respectively comprise frequency information generators 4A, 4B, pitch control sections 9A, 9B, frequency counters 5*a*A – 5*c*A, 5*a*B – 5*c*B, and musical tone waveshape memories 6A, 6B. The construction and operation of these component parts are the same as those employed in the previously described embodiment, so that detailed description thereof will be omitted.

In order to produce tones which are of the same note but have different frequencies, values of the pitch frequency information $P_1 - P_4$ in the two systems are made different from each other. This is achieved by conducting different pitch controlling in the respective systems.

Assume, for example, that the pitch frequency information $P_1 - P_4$ in the system A is set at a position 4P, whereas the pitch frequency information $P_1 - P_4$ in the system B at a position 1P. If a key for the note $A_1$ is depressed, a musical tone waveshape of 108.4 Hz is produced from the system A and, simultaneously, a musical tone waveshape of 110.5 Hz is produced from the system. These musical tone waveshapes are electrically or otherwise synthesized and, when synthesized tone is reproduced, beat is produced due to the frequency difference of 2.1 Hz. Similarly, if a key for the note $A_5$ is depressed, musical tones of 1766.3 Hz and 1768.4 Hz are reproduced and beat is produced due to the frequency difference of 2.1 Hz. It will be understood from the foregoing description that a constant beat is produced owing to the constant frequency difference of 2.1 Hz regardless of the magnitude of frequency of a selected note. The constant beat produces a pleasant musical effect and particularly provides a musical tone with a tone quality resembling that of a pipe organ.

As has previously been described in the chapter I above, beat is produced also in a case wherein modified frequency having a frequency difference of $\Delta fa$ against the nominal frequency and modified frequency having a frequency difference of $\Delta f$ against the nominal frequency are simultaneously reproduced. If, for example, the system A is set at the position 2P and the system B at the position 4P, frequency difference $(\Delta f - \Delta fa)$ between the tones reproduced from the two system is 1.4 Hz, so that a constant beat due to the frequency difference of 1.4 Hz is produced.

According to this embodiment, various beat effects can be produced by suitably varying the pitch frequency information $P_1 - P_4$ in the respective systems. Further, if the pitch control sections 9A, 9B are constructed in such a manner that pitch controlling is possible individually for each keyboard, as has been described with respect to the first embodiment, the single key beat effect can be produced with respect to a particular keyboard only.

In the present embodiment, two musical tone waveshape production systems are provided. The number of the musical tone waveshape production systems is not limited to this but a greater number of systems may be provided. In this latter case, a deeper beat effect is produced owing to a complex sway in the tone reproduced.

In the above described embodiments the modified frequency information is previously stored in the memory 7, 7A or 7B as the stored frequency information. This arrangement is employed for effecting necessary calculation relative to the pitch frequency information by addition and thereby simplifying the construction of the instrument. In a case wherein the nominal frequency information is stored in the memory 7, 7A or 7B, the pitch frequency information must be subtracted to obtain the modified frequency information. Accordingly, the adder 10 must be replaced by a suitable subtracting device. The nominal scale is not limited to the one shown in the above described embodiments but it may be suitably determined so long as it does not give an unpleasant feeling to the audience.

What is claimed is:

1. An electronic musical instrument for producing a musical tone in a modified scale comprising:

means for generating a key address code corresponding to a depressed key;

a frequency information memory for storing a plurality of first frequency information corresponding to a respective keys and producing, upon receipt of said key address code, frequency information corresponding to said key address code;

a pitch control section for generating second frequency information represented by a predetermined frequency information difference with respect to each of said first frequency information;

calculating means for calculating modified frequency information corresponding to a modified scale on the basis of said first frequency information produced from said frequency information memory and said second frequency information a frequency counter for receiving and cumulatively counting the result of calculation by said calculating means; and a musical tone waveshape memory for storing a desired musical tone waveshape which is read out by the output of said frequency counter.

2. An electronic musical instrument as defined in claim 1 wherein said pitch control section comprises means for producing said frequency information represented by a predetermined frequency information difference with respect to each of said first frequency information individually for each keyboard and means for selectively producing said second frequency information in response to a keyboard code in said key address code corresponding to a keyboard of a depressed key, thereby enabling the instrument to control the pitch in the modified scale individually for each keyboard.

3. An electronic musical instrument as defined in in claim 1 wherein said first frequency information is frequency information corresponding to a nominal scale and said calculating means comprise a subtracting device which subtracts said second frequency information from said first frequency information.

4. An electronic musical instrument as defined in claim 1 wherein said first frequency information is frequency information corresponding to a predetermined modified scale and said calculating means comprise an adding device which adds said first frequency information to said second frequency information.

5. An electronic musical instrument as defined in claim 1 further comprising at least one set of said frequency information memory, said pitch control section, said calculating means, said frequency counter and said musical tone waveshape memory, said second frequency information from said pitch control section of the respective sets being made different from each other whereby musical tones of mutually different pitches are simultaneously produced from the respective sets by depression of a single key.

* * * * *